US007549313B2

(12) United States Patent
Espinosa

(10) Patent No.: US 7,549,313 B2
(45) Date of Patent: Jun. 23, 2009

(54) VEHICLE FRAME STRAIGHTENING JIG WITH MULTIPLE END SOCKETS

(75) Inventor: Michael Espinosa, Wichita, KS (US)

(73) Assignee: Spider Pulling Machines, Inc., Wichita, KS (US)

( * ) Notice: Subject to any disclaimer, the term of this patent is extended or adjusted under 35 U.S.C. 154(b) by 327 days.

(21) Appl. No.: 11/391,078

(22) Filed: Mar. 28, 2006

(65) Prior Publication Data

US 2006/0174681 A1 Aug. 10, 2006

Related U.S. Application Data

(63) Continuation-in-part of application No. 10/725,879, filed on Dec. 2, 2003, now Pat. No. 7,017,384.

(51) Int. Cl.
*B21J 13/08* (2006.01)

(52) U.S. Cl. ..... 72/457; 72/705

(58) Field of Classification Search ..... 72/457, 72/482.92, 705, 293, 295, 305
See application file for complete search history.

(56) References Cited

U.S. PATENT DOCUMENTS 4,873,861 A * 10/1989 Bergstrom ..... 72/457
5,031,438 A * 7/1991 Flannery ..... 72/305
6,185,982 B1 * 2/2001 Ballard et al. ..... 72/457
6,978,652 B1 * 12/2005 Meis ..... 72/457
7,150,176 B2 * 12/2006 Thomas ..... 72/422

* cited by examiner

*Primary Examiner*—Edward Tolan
(74) *Attorney, Agent, or Firm*—Marcia J. Rodgers; Polsinelli Shughart PC

(57) ABSTRACT

A vehicle frame and unibody straightening jig has multiple receivers at each end for connection with pulling tower assemblies on all sides of the vehicle. Multiple pulling towers can be installed side-by-side on the same side or end of a vehicle. Receivers at the end of the jig may be installed in parallel orientation. The receivers are selectively removable. The jig also includes lateral support legs or outriggers pivotable about a 90° arc and foldable against the spine to reduce the width of the jig for storage. Height-adjustable, rotatable clamps are mounted on the outriggers for connecting the jig to a vehicle frame or unibody, The clamps are adjustable along the length of the legs to permit connection of the jig with a wide variety of vehicle frames and unibody structures. The jig also includes a carriage assembly with wheels for easy positioning beneath a vehicle.

2 Claims, 6 Drawing Sheets

VEHICLE FRAME STRAIGHTENING JIG WITH MULTIPLE END SOCKETS

CROSS REFERENCE TO RELATED APPLICATION

This application is a continuation-in-part of U.S. application Ser. No. 10/725,879 entitled VEHICLE FRAME STRAIGHTENING JIG filed Dec. 2, 2003, now U.S. Pat. No. 7,017,384.

BACKGROUND OF THE INVENTION

The present invention is broadly concerned with a jig for straightening a metal vehicle frame or body. More particularly, it is concerned with a portable folding jig used in connection with a plurality of pulling towers for simultaneously exerting pulling forces on a vehicle from multiple directions, several pulling towers being positionable on the same side of a vehicle.

Serious collision damage to vehicles such as cars, trucks and sport utility vehicles generally includes misalignment of the frame or unibody structure. The nature and extent of such misalignment may be determined using a centerline gauge to read and record a series of measurements, which are then compared with manufacturers' published vehicle dimension specifications. This enables determination of the severity of under-body damage and mapping of its various locations. The frame damage is then repaired by attaching a pulling tower or power post assembly to a point on a vehicle frame or unibody structure and actuating a hydraulic ram to pull the deformed portion of the frame and body into alignment. By performing a series of pulls, the chassis including the frame or unibody may be returned to its proper dimensions and alignment.

Large, bench-type frame machines may be employed to secure the vehicle during this procedure. These machines typically include a drive-on supporting platform or table with a series of apertures spaced around the perimeter for attachment of a pulling chain which is actuated by a pulling tower. The vehicle is supported above the table by clamps to the pinch weld of a unibody, and the chains are hooked to the damaged sections. Fixed beams are coupled with the table, and are capable of mounting multiple pulling devices. These bench-type machines are powerful and effective, and they permit a full range of movement of the pulling devices to any position around the vehicle. The pulling towers can be positioned side-by-side, on one side of the table for straightening side damage to the vehicle. But these machines are expensive to purchase as well as to operate, since technicians must be trained in their use. They take up a full bay in a body shop and are too heavy and cumbersome to be moved about when not in use.

Floor mounted platform systems have been developed which provide a somewhat cheaper alternative. In these systems, the platform is bolted to the shop floor and so-called "floor pots" are cemented into the floor at preselected locations for coupling with the pulling towers. These systems do not stand as high as the larger frame machines because they do not include structure for lifting the vehicle. They are large, however, taking up a full bay, and they require permanent installation.

Alternatively, an individual post-type pulling device can be chained between a floor pot and the vehicle and actuated to pull one damaged section of a vehicle at a time while the vehicle remains on the floor. Such portable towers are well-suited to exert pulling force along the longitudinal axis of the vehicle. However, in order to provide a range of pulls, they must be moved about the vehicle. They are not well configured to perform side pulls, since multiple devices cannot be positioned on one side of a vehicle, and they do not make lower pulls with the power of the larger machines. Mechanics dislike working with such devices on the floor, as access to the underside of the vehicle is limited and inconvenient.

In recent years there have been attempts to develop portable frame straightening machines or jigs that permit attachment of pulling towers to a portable base. Such jigs permit simultaneous attachment of more than one pulling tower, like the big machines, but the towers have a limited range of motion. In order to provide a range of pulls, the base and towers must be disengaged and repositioned. Such machines also do not permit attachment of the towers adjacent each other on one side of the vehicle, for example, to perform a side pull using multiple towers. They also do not permit attachment of multiple towers at each end of a vehicle. A particular advantage of such portable frames is that they can be stowed in a convenient location when not in use.

There is still a need for an economical, portable jig that provides the complete range of pulls as well as simultaneous pulls from the same side of a vehicle that have previously been available only with large platform collision repair systems.

SUMMARY OF THE INVENTION

The present invention provides a greatly improved vehicle frame and body straightening jig which is portable for easy positioning beneath a vehicle and connection with the frame or unibody structure, and which provides eight or more joints radiating from a central spine for attachment of pulling tower assemblies to provide a range of pulls not previously available with portable devices. The jig can support multiple pulling towers on opposite ends or sides of a vehicle. The jig can also support multiple pulling towers on the same side of a vehicle without the need for additional anchoring. It is adjustable to enable coupling with a variety of types of vehicles. The jig is relatively light weight and is easily movable when supporting a vehicle.

The jig includes an elongated central spine with a plurality of receivers or sockets at each end as well as a plurality of receivers positioned at various intermediate positions along the spine. The receivers may be selectively removed and repositioned along the spine. A pulling tower assembly may be connected to each of the receivers. The jig also includes a series of laterally extending support legs or outriggers that may each be pivoted about a 90° arc from the spine and may also be folded flat against the spine to reduce the width of the jig for storage. Clamps are mounted on the outriggers for connecting the jig to a vehicle frame or unibody. The clamps are adjustable along the length of the legs to permit connection of the jig with a wide variety of vehicle frames and unibody structures. The height of the clamps is adjustable to accommodate pinch welds on a variety of vehicles having different ground clearances. The clamps are also rotatably adjustable for engagement with pinch welds that are bent out of alignment. The jig includes a carriage assembly with wheels.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2:
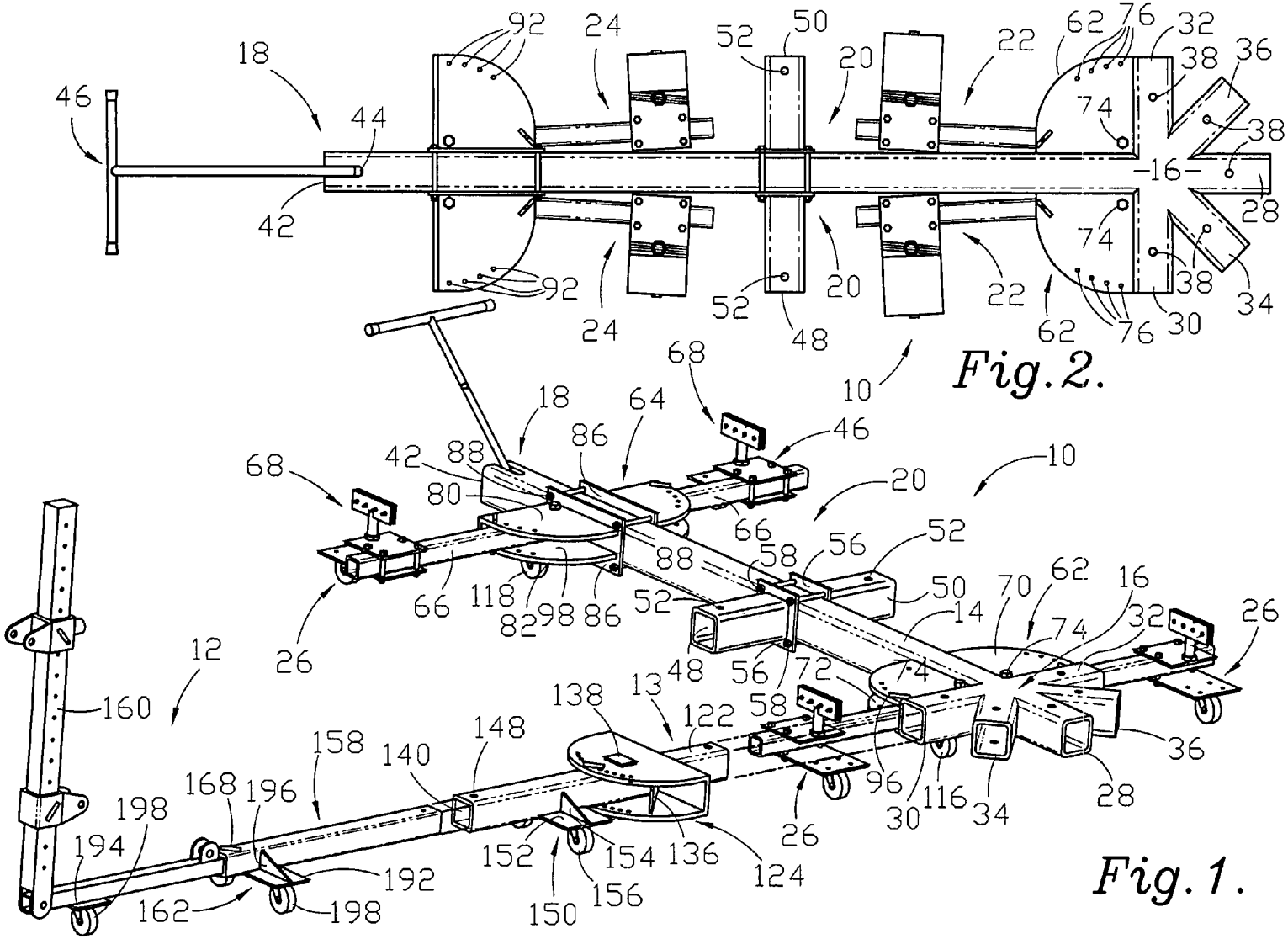
FIG. 1 is a perspective view of a frame straightening jig apparatus.
FIG. 2 is a top plan view of the jig depicted in FIG. 1 in a folded configuration suitable for stowing.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawing figures, the reference numeral 10 refers to a vehicle frame and body straightening jig apparatus in accordance with the invention, which is depicted in FIGS. 1,3,6, 7 and 8 in association with one or more pulling assemblies or towers 12 which are connected thereto by swivel attachments 13. The jig 10 includes a base or spine member 14 having a spider joint 16 at one end, an end joint 18 at the opposite end, and at least one central or intermediate joint 20 therebetween. The apparatus 10 also includes a pair of forward outrigger assemblies 22 and a pair of aft outrigger assemblies 24, each including a carriage assembly 26.

Figures 3, 4:
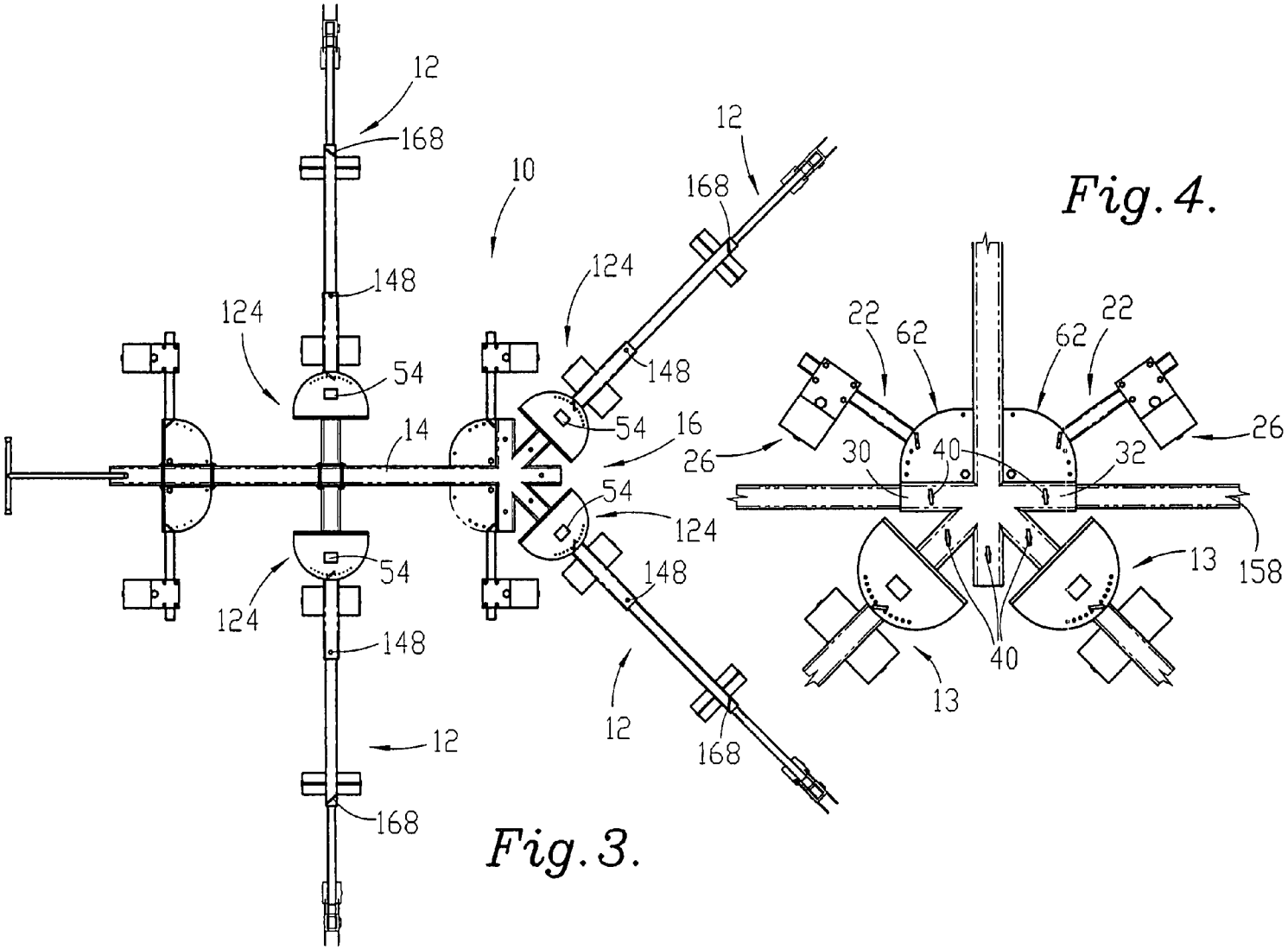
FIG. 3 is a top plan view of the of the jig at a reduced scale and showing four pulling devices attached to the jig.
FIG. 4 is a top plan view of the joint section of the jig at a somewhat enlarged scale with parts of four pulling devices installed in the spider joint.

In more detail, the spine 14 is a fairly narrow, elongated structure. A first end terminates in the spider joint 16, having five angularly spaced sockets or receivers including a central socket 28 aligned or coaxial with the spine 14, a pair of orthogonal lateral sockets 30 and 32 and a pair of diagonal sockets 34 and 36 therebetween. The five sockets or receivers 28, 30, 32, 34 and 36 radiate at 45° intervals within a 180° arc. Each of the sockets includes an aperture 38 for receiving a pin 40 (FIG. 4).

Figure 6:
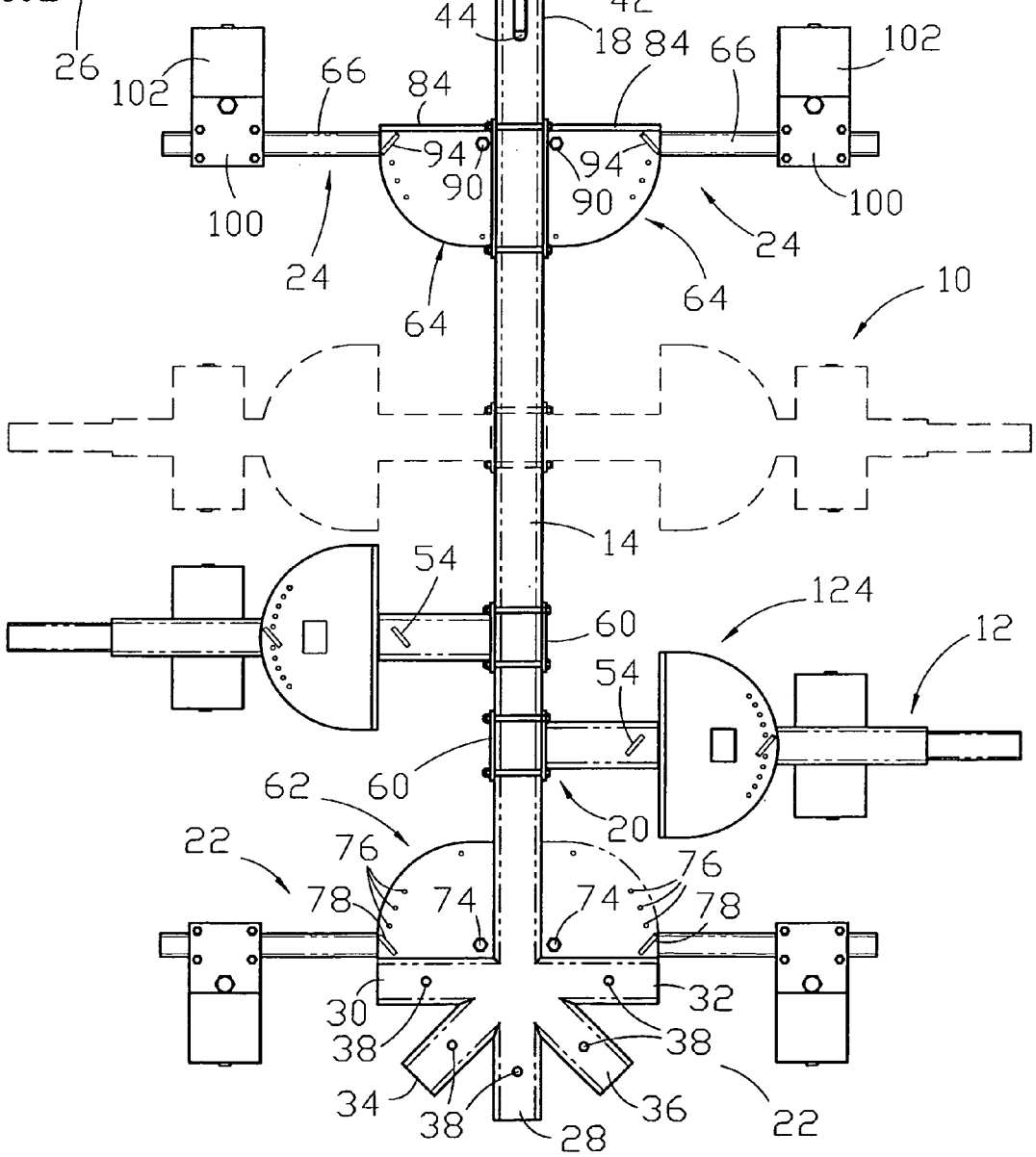
FIG. 6 is a view similar to FIG. 2 with the center socket shown in a longitudinally displaced position.

The second end of the spine 14 terminates in the end joint 18. The joint 18 includes a receiver or socket 42 having an aperture 44 for receiving an optional handle 46 or a pin (not shown). A midportion of the spine 14 includes a central or intermediate joint 20 having a pair of receivers or sockets 48 and 50 which may be in opposed or staggered relation on either side of the spine 14 or on the same side of the spine (FIG. 6). The outstanding lateral end of each socket 48 and 50 includes an aperture 52 for receiving a pin 54. A spine-contacting portion of each socket 48 and 50 includes an orthogonally expanded foot 56 (FIG. 1). The length and width of the foot 56 exceed the diameter of the spine 14. The perimeter of the foot 56 is apertured, so that the pair of sockets 48 and 50, can be aligned in opposed relation on either side of the spine 14 and connected by means of bolts 58 straddling the upper and lower surfaces of the spine 14. Where it is desirable to stagger or offset the sockets 48 and 50 at different locations along the length of the spine 14, a pair of apertured plates 60 is employed to receive the bolts 58 from the sockets 48 and 50 (FIG. 6).

The forward and aft pairs of outrigger assemblies 22 and 24 include respective pairs of generally quadrant-shaped pivot assemblies 62 and 64. Each outrigger assembly 22 and 24 also includes a support leg 66 and a vehicle connector assembly 68.

The forward pivot assemblies 62 each include a pair of planar, quadrant-shaped upper and lower pivot or sector plates 70 and 72 welded in horizontal, spaced, parallel relation at the perpendicular junction of the spider joint 16 with the spine 14. Each pair of pivot plates 70 and 72 is apertured adjacent the junction for receiving a pivot bolt 74. The curvate perimeter of each of the pivot plates 70 and 72 includes a series of spaced apertures 76 for receiving pins 78 (FIG. 6) to fix the support members 66 in place.

The rear pivot assemblies 64 each include a similar pair of planar, quadrant-shaped upper and lower pivot or sector plates 80 and 82. Rearward-facing margins or radii of the pivot plates 80 and 82 are interconnected by a rear sidewall 84 (FIG. 6) which serves as a stop against 180° rotation of the support legs 66 to a rearward projecting position adjacent the spine 14. The center-facing margins or radii are interconnected by a center sidewall 86 having vertical dimensions which slightly exceed the diameter of the spine 14. The perimeter of the sidewalls 86 are apertured so that so that a pair of rear pivot assembly sidewalls 86 can be aligned in opposed relation on either side of the spine 14 and connected using fasteners such as bolts 88 straddling the spine 14. Alternatively, the center sidewalls 86 can be constructed in the same manner as the rear sidewalls 84, and the center sidewalls 86 fastened in place on the spine 14 by welding. Like the forward pivot assemblies 62, each pair of pivot plates 80 and 82 of the rear pivot assemblies 64 is apertured adjacent the junction for receiving a pivot bolt 90. The curvate perimeter of each of the plates 80 and 82 also includes a series of spaced apertures 92 for receiving pins 94 (FIG. 6). Those skilled in the art will appreciate that the pivot plates 70, 72, 80 and 82 need not be quadrant or sector shaped. It is foreseen that the pairs of upper pivot plates 70 and 80 may each be joined to form a single, generally semi-circular respective forward or rear upper pivot plate and that the pairs of lower pivot plates 72 and 82 may be similarly joined. The center sidewall 86 is preferably omitted from the rear plates 80 and 82. Such semi-circular upper and lower plates 70 and 72 and 80 and 82 are fastened to the upper and lower surfaces of the spine 14 by means of welding or fasteners.

In both forward and rear pivot assemblies 62 and 64, the space between the parallel pivot plates 70 and 72 and 80 and 82 forms a slot 96 or 98 sized for receiving a support leg 66. The support legs 66 are of tubular steel construction, and each is apertured through at one end to receive a pin 78 or 94 for pivotal connection with a respective pivot assembly 62 or 64.

Figure 5:
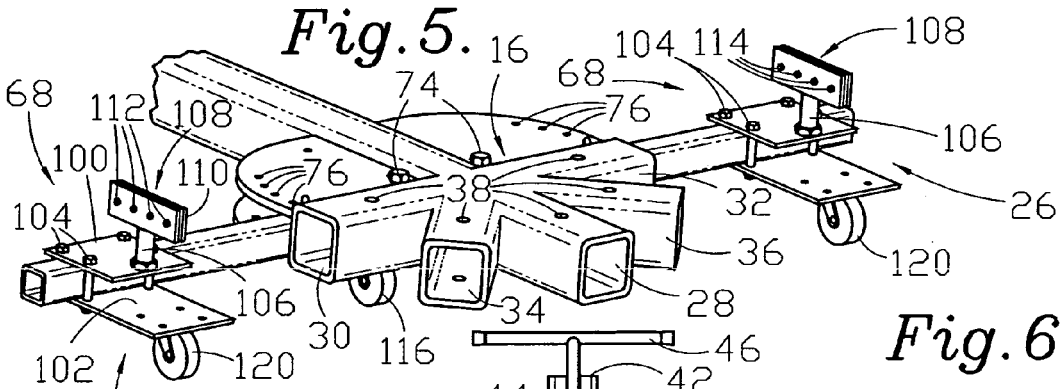
FIG. 5 is a fragmentary perspective view at an enlarged scale and shows the outriggers, carriage assemblies and pinch weld clamps.

A vehicle connector assembly 68 is attached to the outer end of each support leg 66. Each connector assembly 68 includes a generally planar top support plate 100 and bottom support plate 102 (FIG. 5). The top plate 100 is approximately square, while the bottom plate 102 is somewhat elongated. The plates are sized to exceed the dimensions of the legs 66 and are correspondingly apertured to receive bolts 104, which straddle the sides of the legs 66 to connect the support plates 100 and 102. The upper support plate 100 supports an upstanding stem 106 (FIG. 6). A pinch weld clamp or grip 108 is vertically adjustably mounted on the stem 106, and includes a pair of elongate clamping plates 110 and 112. The plates are adjustably interconnected by bolts 114. The clamp 108 is adapted to grip a peripheral pinch weld typically employed in unibody constructions to connect a lower section and a side section of sheet metal. Those skilled in the art will appreciate that, where the vehicle to be repaired is of body-over-frame construction, adaptors suitable for attachment to a section of the frame may be substituted for the clamps 112.

The jig 10 is movably supported on a carriage assembly 26, which includes a pair of front casters 116 (FIG. 1) secured by welding or other suitable means to the lower surfaces of the lateral sockets 30 and 32 of the spider joint 16. The carriage assembly 26 also includes a pair of rear casters 118, similarly secured to the lower surfaces of the lower pivot plates 82 of the rear pivot assemblies 64. An outrigger caster 120 (FIG. 5) is also secured to the lower surface of the portion of the elongate bottom support plates 102 that extends beyond the top support plates 100 of the connector assemblies 68 of the support legs 66.

Figures 7, 8:
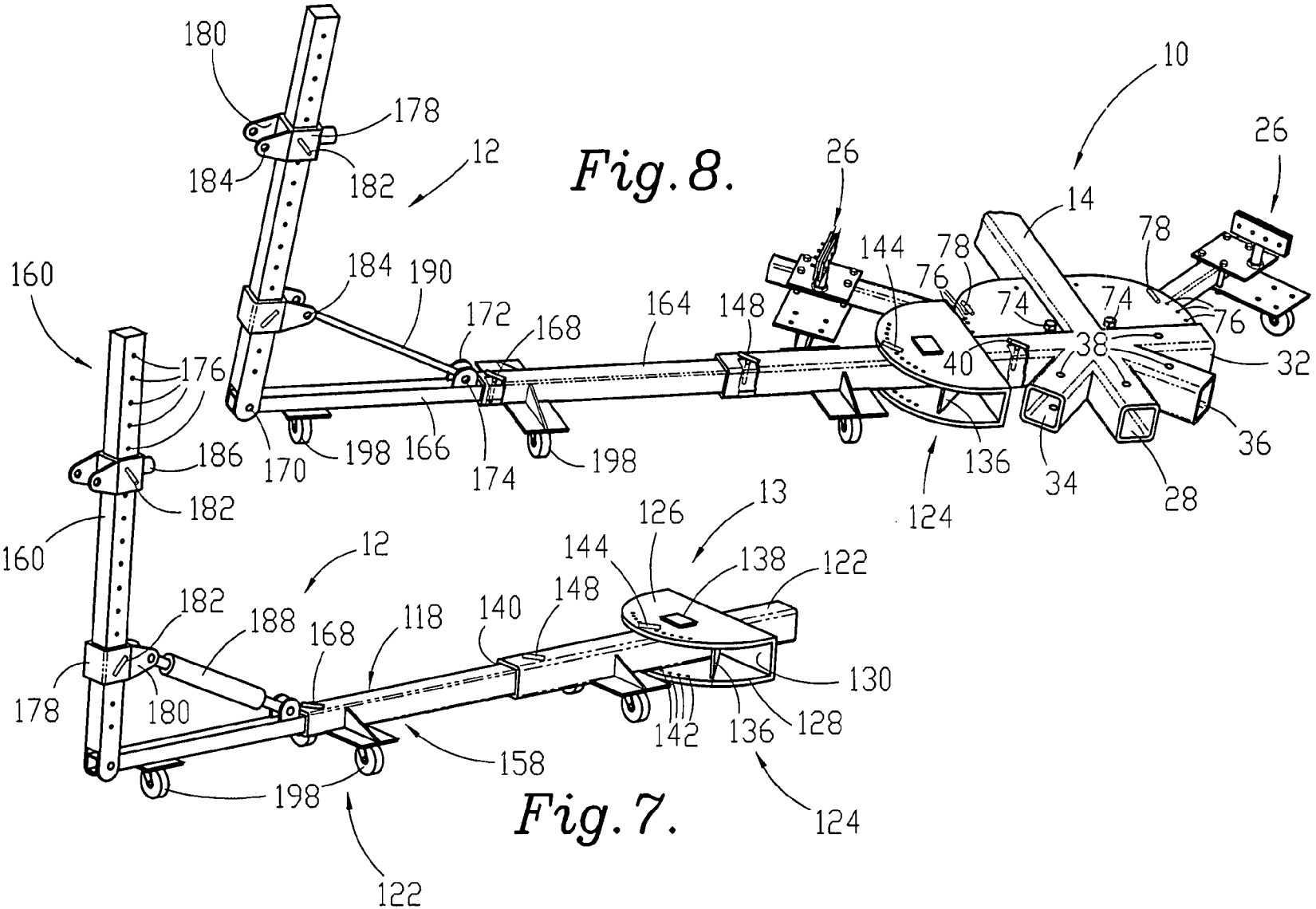
FIG. 7 is a perspective view of a pulling tower assembly installed in a swivel attachment for use in conjunction with the jig.
FIG. 8 is a fragmentary perspective view of the spider joint of the jig showing a swivel attachment intercoupling an attached pulling tower assembly to one socket of the joint.

The frame straightening jig 10 of the present invention is designed for use in conjunction with a plurality of conventional pulling assemblies or towers 12, best shown in FIGS. 1, 7 and 8, each interconnected to the jig 10 by a swivel assembly or attachment 13. The swivel attachments 13 each include a leg 122 sized for reception in one of the jig sockets 28, 30, 32, 34, 36, 42, 48 or 50 and coupled with a pivot joint 124. The pivot joint 124 includes a pair of semicircular upper and lower pivot or sector plates 126 and 128 connected by a rear sidewall 130 along the diameter or straight margin. It is foreseen that the pivot plates 126 and 128 may be constructed in other shapes, such as, for example, the generally elongated shape depicted in U.S. Pat. No. 6,216,524 B1. A space or slot 132 between the pivot plates 126 and 128 is subdivided by a pair of diagonal sidewalls or stops 134 and 136. The pivot plates 126 and 128 are centrally apertured to receive a pivot or link pin 138 for connecting a socket member 140. The perimeter of the plates 126 and 128 include a series of sets of vertically aligned spaced apertures 142 for receiving a pin 144 for holding the socket 140 at a predetermined angular orientation. The outer end of the socket member 140 is also apertured for receiving a pin 148. A carriage assembly 150 includes an elongate support plate 152 having on its upper surface a pair of upstanding right triangular supports or gussets 154 providing bracing for rigidity, and on its lower surface, a pair of ground-engaging casters 156.

Each pulling tower assembly 12 includes a telescoping section or tongue 158 pivotally connected to an upstanding post section or tower 160 and an outer carriage assembly 162.

The tongue 158 includes a first segment or section 164 (FIG. 8) that is inwardly extending during normal use, and an outer second segment or section 166. The sections 164 and 166 are vertically apertured at each end and are held in place in telescoping relation by pins 168, except that the outer end of the second section 166 is horizontally apertured for pivotal connection with the tower section 160 by a pivot pin 170. An inward end of the second section 166 includes a pair of upstanding ears 172, equipped with a pair of horizontally aligned apertures 174.

The sides of the upstanding tower post or section 160 include a series of aligned, vertically spaced horizontal apertures 176 and a pair of brackets 178 which wrap around the tower post 160 and terminate in a forwardly projecting pair of ears 180. The brackets 178 are horizontally apertured to receive pins 182 for holding them in aligned placement with a preselected horizontal aperture 176. The ears 180 also include apertures 184. The uppermost bracket 178 is mounted with the ears 180 projecting outwardly, and the inward facing surface of the bracket 178 includes a boss 186. As shown in FIG. 7, the ears 172 and 180 are coupled with the ends of a cylinder 188, which is actuated by a hydraulic or compressed air system (not shown). Alternatively, FIG. 8 depicts the ears 172 and 180 coupled with a rigid link 190 as may be employed when the tower assembly 12 is employed as a fixed position anchor.

The pulling tower carriage assembly 162 includes first and second support plates 192 and 194 (FIG. 1) mounted below respective first and second sections 164 and 166. The first support plate 192 is elongate, including on its upper surface a pair of upstanding right triangular supports or gussets 196 for preventing lateral movement of the first section 164 on the plate 192. The second support plate 194 is generally square shaped. The lower surfaces of each support plate 192 and 194 include a pair of ground-engaging casters 198.

The jig 10 is preferably formed of square tubular steel construction, although round tubular steel or solid bars may also be employed. Those skilled in the art will appreciate that, while the drawing figures depict a jig 10 having eight socket receivers with a five socket spider joint 16 at one end and an end joint 18 having one receiver 42, the end joint 18 may also be constructed to include a spider joint so that the jig may include 12 sockets. It is also foreseen that the intermediate joint 20 may include more than two sockets 48 and 50, so that the jig may include as many as 14 or more sockets.

In use, a mechanic or technician employs a jack to raise one end of a vehicle such as a car, truck or the like. The jig 10, in normal storage configuration with the outriggers 22 and 24 folded against the spine 14, is easily rolled into place below the vehicle by guiding the carriage assembly 26 using the optional handle 46. The mechanic positions the jig 10 so that the spine 14 is aligned with the longitudinal axis of the vehicle, with the spider joint 16 at one end and the end joint 18 at the other. If the end socket 42 is to be used, the handle 46 is removed. The outriggers 22 and 24 are unfolded from the spine 14 and extended laterally, and the connector assemblies 68 are adjusted along the length of the legs 66 as may be needed to connect the pinch weld or jack tabs between the clamping plates 110 and 112. If necessary, one or more outriggers may also be rotated slightly to achieve alignment of the connector assemblies 68 with the pinch weld. The clamp 108 is then tightened in place over the pinch weld. Depending on the pattern of the collision damage and the necessary pulls, it may be desirable to first remove one of the wheels in order to facilitate placement of an outrigger 22 or 24. The clamped end of the vehicle is then lowered, and the process is repeated at the opposite end. In this manner, the jig 10 is connected through the outriggers 22 and 24 to the vehicle by two pairs of clamps 108 on each side of the vehicle, each pair of clamps 108 being in approximately opposed relation.

The mechanic next connects a pulling tower assembly 12 to a swivel attachment 13 by inserting the end of the tongue 158 into the socket 140, aligning the apertures and inserting a pin 168. The swivel attachment leg 122 is inserted into a socket of the jig 10, for example the lateral socket 30. The pin 144 of the swivel attachment socket member 140 may be removed and the socket member 140 rotated in the pivot joint 124 to a desired position and the pin 144 replaced to secure the angular attitude of the attachment 13. One end of a chain (not shown) is then coupled with the upper tower bracket 178 and the other end attached to a point on the vehicle to be pulled.

The process may be repeated to install a second pulling tower assembly 12 in the intermediate socket 48, for example, to permit a simultaneous pull using side-by-side pulling assemblies 12. The hydraulic cylinders 188 are next actuated to perform the pull. It is foreseen that a hydraulic cylinder may be coupled with the boss 186 of the upper bracket 178, and that a pulling tower assembly 12 may be employed to push against the vehicle rather than pull. It is also foreseen that any or all of the five sockets 28, 30, 32, 34 and 46 of the spider joint 16 as well as the two sockets 48 and 50 of the intermediate joint, and the end socket 42 may be equipped with pulling tower assemblies 12 for simultaneous side-by-side, diagonal, or opposed pulling, pushing, or any combination thereof. Where the vehicle is of body-over-frame construction, the connector assemblies 68 may be equipped with adaptors to receive a frame member. Once initial frame straightening pulls are made measurements can be made to determine if desired alignment of the frame has been achieved. IF not, adjustments in the positions of the tower 12 can be made and the process repeated until the frame alignment has been restored.

The jig may also be used as a dolly, to move the vehicle about on the floor of the shop. When the pulling operations have been completed, the installation process is reversed, including replacement of any wheels that have been removed. The jig 10 is then folded to its storage position by rotating the forward and aft outriggers 22 and 24 to a position adjacent the spine 14. In this manner, the width of the jig 10 is substantially reduced so that it can be stored out of the way.

Figure 9:
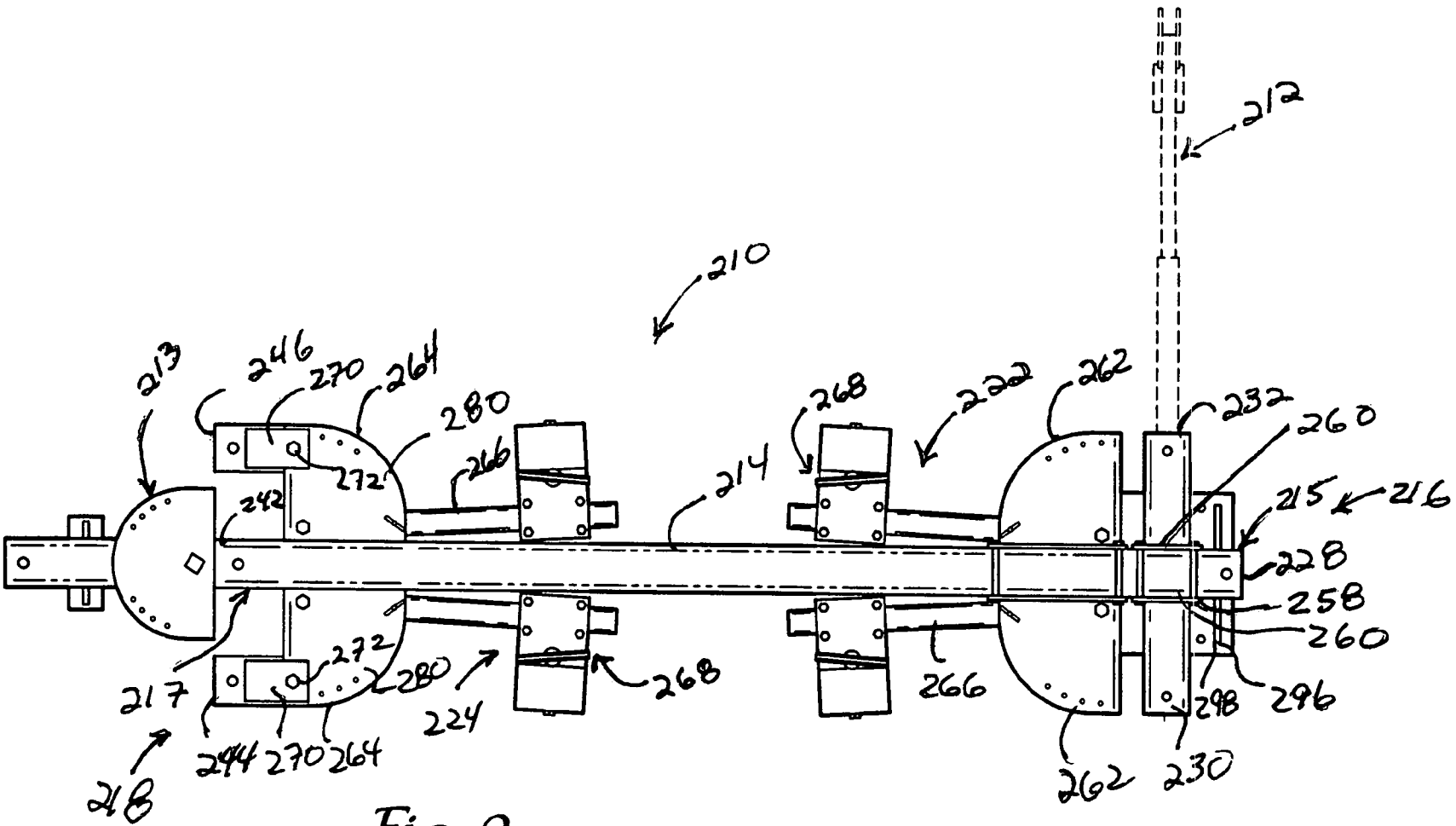
FIG. 9 is a top plan view of an alternate embodiment of the frame straightening jig with a pulling device shown in phantom.
Figure 10:
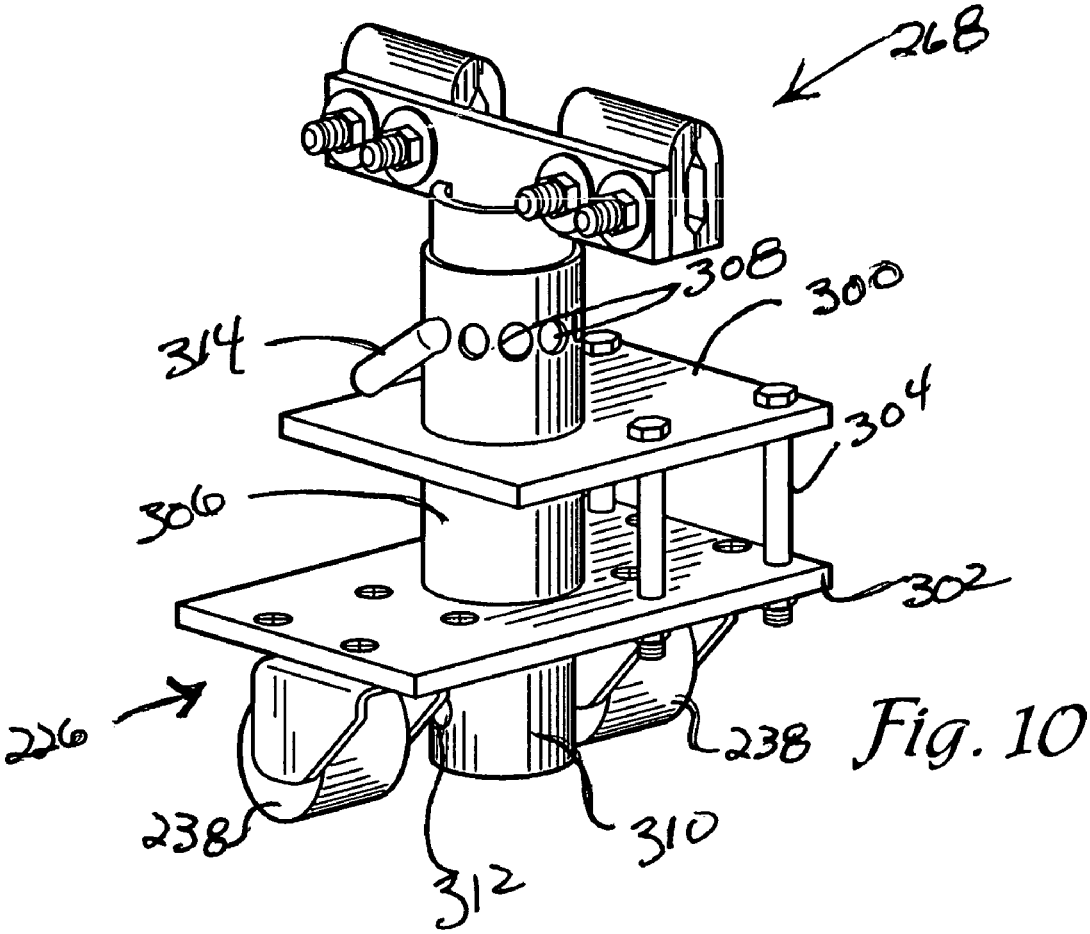
FIG. 10 is an enlarged perspective view of a vehicle connection device.
Figure 11:
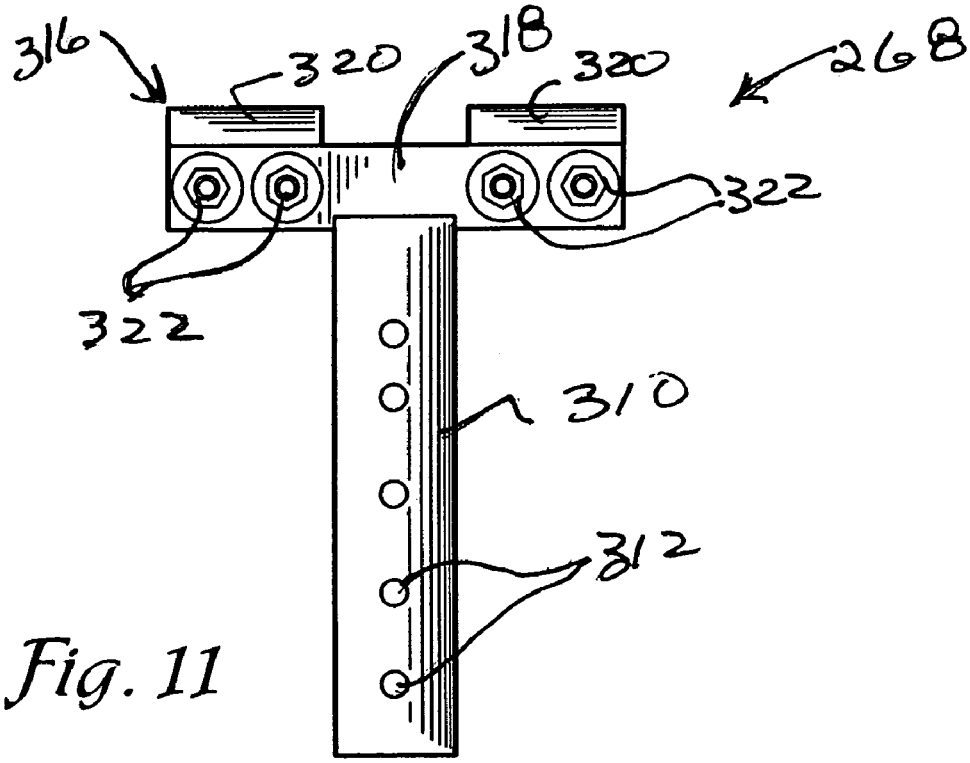
FIG. 11 is a fragmentary perspective view of the vehicle connection device with parts omitted to show the support post with vertical adjustment apertures and frame connection device.

An alternate embodiment of the vehicle frame straightening jig apparatus is generally designated by the reference numeral 210 and is depicted in FIGS. 9-11 in association with a pulling assembly or tower 212, one or more of which may be connected directly to the jig as shown in FIG. 9, or may be interconnected to the jig 210 by a swivel attachment 213 substantially as previously described. The alternate jig 210 includes an elongated base or spine member 214 having first and second joints 216 and 218, pairs of first and second outrigger assemblies 222 and 224, each including an outrigger support leg 266 coupled with a carriage assembly 226 (FIG. 10) and a vehicle connection device 268, and connected to the spine 214 by respective first and second pairs of pivot assemblies 262 and 264 substantially as previously described.

The spine 214 has a pair of opposite ends 215 and 217. The first end 215 is coupled with a plurality of sockets or receivers to form a first joint 216, including a central receiver 228, and spaced apart side receivers 230 and 232. The central receiver 228 is aligned or coaxial with the spine 214 and the two elements may be of unitary construction. The side receivers 230 and 232 may be configured in opposed relation to form a generally T-shape in combination with the central receiver 228 for opening in a transverse orientation as shown in FIG. 9, or they may be in a staggered or offset transverse relation to the spine 214 to form an approximately Z-shape or one or both of the receivers may be angled or generally diagonal in spaced relation to the central receiver 228. Where both of the receivers 230 and 232 are angled, the overall configuration will be similar to that of receivers 34 and 36 previously described. The illustrated receivers 230 and 232 may also be selectively disengaged and removed from the spine 214.

Each of the sockets or receivers is engageable with a pulling assembly 212 or with a swivel attachment 213 which in turn engages a pulling assembly 212 for pivoting or swiveling of the pulling assembly 212 to achieve a preselected pulling angle with respect to a vehicle. The sockets 230 and 232 each include an orthogonally expanded foot 260 that is sized to exceed the diameter of the spine 214 and apertured adjacent the perimeter. The sockets are held in place on the spine 214 by bolts 258 through pairs of opposed feet 260. The first pair of pivot assemblies 262 is attached to the spine 214 in similar fashion. Where the sockets 230 and 232 or pivot assemblies 262 are not installed in offset relation, a plate is employed similar to that shown in FIG. 6 and previously described.

The opposite second end of the spine 217 is also coupled with a plurality of sockets to form a second joint 218 including a central receiver 242 and parallel spaced apart side receivers 244 and 246. The central receiver 242 is coaxial with the spine and the two elements 242 and 218 may be of unitary construction. The side receivers 244 and 246 are attached to the pivot assemblies 264 by means of pairs of plates 270 that are welded onto the upper and lower surfaces of each receiver 244 and 246 and attached to the respective tops and bottoms of the upper and lower pivot plates 280 by means of bolts 272. While the bolts 272 enable the side receivers 244 and 246 to be selectively removed, it is foreseen that the plates 270 could also be welded or otherwise permanently secured to the respective upper and lower surfaces of the pivot plates 280. The receivers 242, 244 and 246 of the second joint 218 are depicted in FIG. 9 in spaced parallel relation for opening in the same direction, and it is also foreseen that they may be connected to the spine 214 in a generally T-shape, offset or Z-shape for opening in a transverse orientation, or they may be connected to form an angled shape as previously described with respect to the receivers of the first joint 216.

The spine 214 is supported at either end by a carriage assembly (not shown). The carriage assembly at the first end of the spine 215 includes a pair of ground engaging front wheels or casters as previously described and fastened to a plate 296 (FIG. 9) that is coupled with the central socket or receiver 228 in supporting relation. Where the receiver 228 is constructed to be removable from the spine 214, then the plate 296 may be coupled behind the receiver 228 with the first end of the spine 215. A pair of upstanding, generally triangular gussets 298 extend between the plate and the receiver 228 to provide lateral support. The plate 296 and gussets 298 may be connected with the spine 214 or central receiver 228 by welding or any other suitable means of attachment. The carriage assembly at the second end of the spine 217 is of similar construction, except that it may be secured to the lower surfaces of the rear pivot plates 280 without gussets.

Each of the outrigger support legs 266 is also supported by a carriage assembly 226 adjacent the outboard end (FIG. 10). Each outrigger support leg 266 also supports a vehicle connection device 268 for connecting the jig 210 to a vehicle frame or body. The vehicle connection device 268 includes top and bottom support plates 300 and 302 apertured to receive bolts 304. The bottom support plate 302 is secured atop the wheels or casters 238, and the top support plate 300 is adjustably connected to the bottom support plate 302 in clamping relation to the outrigger legs 266 as previously described.

The top plate 300 is apertured for reception of a generally cylindrical and upright or vertical sleeve 306, the lowermost end of which is secured to the uppermost surface of the bottom plate 302 as by welding or the like. The bottom plate 302 includes a slightly smaller aperture aligned with the sleeve 306, for sliding reception of a vehicle support post or stem 310 therethrough. The sleeve 306 is sized for sliding, telescoping reception and 360 degree axial rotation of the upstanding vehicle support post 306 to provide the vehicle connection device 226 with two degrees of freedom. Because the top and bottom plates 300 and 302 are of different lengths, the sides and one of the ends are aligned, with one end of the bottom plate 302 extending beyond the corresponding end of the top plate 300. The aperture in the bottom plate 302 is preferably centrally located to provide greater stability, necessitating offset of the aperture in the top plate 300 to compensate for the shorter length of the plate.

The sleeve 306 includes a plurality of radially spaced apertures or holes 308 aligned in spaced relation with the upper margin thereof. The post 310 includes a plurality of sets of vertically spaced apertures or holes 312 along the length thereof. A removable pin 314, illustrated as L-shaped, is provided for reception through the aligned apertures 308 and holes 312 for coupling the post 310 with the sleeve 306 when the post 310 and attached pinch weld clamp 316 are positioned at a preselected height and angle of rotation.

The upper end of the post 310 is coupled with a pinch weld clamp or grip 316, which includes an elongate, generally flat and rectangular supporting crossbar 318 supporting two pairs of shorter clamping jaws 320. While the clamp jaws 320 are depicted as having a generally C-shaped cross section, they may also be of generally flat, ribbed, tongue and groove or any other configuration suitable for efficiently grasping and holding a vehicle pinch weld. The upper end of the post 310 is notched through for reception of the crossbar 318, which may be secured by welding or other suitable means. One of each pair of clamp jaws 320 may be secured to the crossbar 318, as by welding. Pairs of threaded bolts 322 through the crossbar 318 adjustably secure the clamp jaws 320 to each other in pairs.

In use, the outrigger support legs 266 are pivoted to a folded position generally parallel and adjacent to the spine member. 214 Where necessary the connection devices 268 may be removed from the jig 210 to improve clearance. A mechanic or technician raises the vehicle, rolls the jig 210 underneath and extends the outriggers 222 and 224 substantially as previously described.

The mechanic assesses the longitudinal alignment of each of the pinch weld clamps 316 with the vehicle pinch welds by sight and, if necessary, adjusts the alignment of one or more of the clamps 316 by removing the pin 314 and rotating the clamp 316 and attached post 310 within the sleeve 306 until the clamp aligns with the pinch weld. Where the vehicle is particularly long, it may be desirable to move the outriggers closer together for stability. The first outrigger assembly 222 may be repositioned along the spine 214 so that it is closer to the second outrigger assembly 224 by loosening the bolts securing the pivot assemblies 262 and sliding the assemblies along the spine 214 toward the center.

The height of the clamp 316 is adjusted by raising the post 310 to the desired height. The pin 314 is then reinserted through a selected one of the sleeve apertures into an aligned vertical post hole 312. The vehicle is next lowered until the clamps 316 engage the pinch welds. The opposed pairs of clamp jaws 320 are tightened over the pinch welds by tightening the bolts 322.

The mechanic next connects pulling tower assemblies 212 to one or more swivel attachments 213 which are inserted into selected receivers 228, 230, 232, 242, 244 and/or 246, as well as any intermediate receivers (not shown) and the pulling operation is accomplished substantially as previously described. Advantageously, three pulling towers 212 may be positioned at each end of the spine, and additional towers may be positioned on optional receivers installed on the center portion of the spine. The pulling towers 212 and swivel attachments 213 may be freely repositioned within selected receivers for subsequent pulls without the need for remounting or repositioning of the vehicle on the jig 210. The large number of receivers in combination with their distribution at selected points all around a vehicle and their use in combination with the swivel attachments 213 and known rotatability of the pulling towers 212 permits a flexible combination of compound and/or complex pulls from virtually any location with respect to a vehicle.

It is to be understood that while certain forms of the present invention have been illustrated and described herein, it is not to be limited to the specific forms or arrangement of parts described and shown.

What is claimed and desired to be secured by Letters Patent is as follows:

1. A vehicle connection device for a vehicle frame and body straightening jig and comprising:

(a) a first support plate having a post hole formed therethrough;

(b) an upright sleeve coupled with said first support plate in alignment with said post hole and including a plurality of circumferentially spaced sleeve apertures;

(c) a vehicle support post received within said sleeve and through said post hole, said support post including a plurality of vertically space post apertures, said post apertures cooperating with said sleeve apertures to enable axial and angular adjustment of said post relative to said sleeve;

(d) a frame connection device positioned at an end of said support post and enabling connection to a frame or body of a vehicle, said frame connection device being a pinch weld clamp and including:

(1) a cross bar positioned at a top end of said post having a first jaw member secured thereto;

(2) a second jaw member positioned in spaced relation to said first jaw member; and (3) a threaded jaw fastener engaged between said first jaw member and said second jaw member and operable to clampingly urge said second jaw member toward said first jaw member to thereby clamp a pinch weld of a vehicle body therebetween;

(e) a locking pin receivable through one of said sleeve apertures and into a selected aligned post aperture thereby enabling vertical and angular adjustment and locking in place of said frame connection device;

(f) a second support plate slidably engaged with said sleeve and positioned in spaced relation above said first support plate;

(g) ground engaging wheels coupled with said first support plate; and (h) a plurality of threaded clamp fasteners engaged between said first and second support plates and operable to urge said support plates into adjustable clamping engagement with a movable horizontal component of said jig.

2. A vehicle connection device as set forth in claim 1 and including:

(a) a pair of the first jaw members positioned in spaced relation along said cross bar;

(b) a pair of the second jaw members positioned in spaced relation respectively with said first jaw members; and (c) a plurality of the threaded jaw fasteners engaged between said first jaw members and said second jaw members and operable to clampingly urge said second jaw members toward said first jaw members.

* * * * *